US008758047B2

(12) United States Patent
Dietz et al.

(10) Patent No.: US 8,758,047 B2
(45) Date of Patent: Jun. 24, 2014

(54) PORT REPLICATION ASSEMBLY WITH ADAPTER CABLE AND RELATED METHODS OF USE

(75) Inventors: William H. Dietz, Branford, CT (US); Gregg J. Lafontaine, Lebanon, CT (US)

(73) Assignee: Ortronics, Inc., New London, CT (US)

( * ) Notice: Subject to any disclaimer, the term of this patent is extended or adjusted under 35 U.S.C. 154(b) by 322 days.

(21) Appl. No.: 13/173,061

(22) Filed: Jun. 30, 2011

(65) Prior Publication Data

US 2012/0064760 A1 Mar. 15, 2012

Related U.S. Application Data

(63) Continuation-in-part of application No. 12/714,630, filed on Mar. 1, 2010, now Pat. No. 8,182,294, and a continuation-in-part of application No. 12/427,128, filed on Apr. 21, 2009, now Pat. No. 7,695,328, and a continuation-in-part of application No. 11/800,587, filed on May 7, 2007, now Pat. No. 7,628,657.

(51) Int. Cl.

| | |
|---|---|
| ***H01R 13/60*** | (2006.01) |
| ***H01R 13/518*** | (2006.01) |
| ***H01R 24/64*** | (2011.01) |
| *H01R 33/90* | (2006.01) |

(52) U.S. Cl.

CPC ..... *H01R 13/518* (2013.01); *H01R 24/64* (2013.01); *H01R 33/90* (2013.01)

USPC ..... 439/540.1

(58) Field of Classification Search

USPC ..... 439/862, 638, 676, 502, 540.1

See application file for complete search history.

(56) References Cited

U.S. PATENT DOCUMENTS

| | | | |
|---|---|---|---|
| 3,585,568 | A | 6/1971 | Hervig et al. |
| 4,443,051 | A | 4/1984 | Aguilar |
| 4,602,842 | A | 7/1986 | Free et al. |
| 4,749,363 | A | 6/1988 | Luska et al. |
| 4,904,209 | A | 2/1990 | Nelson |
| 5,538,438 | A | 7/1996 | Orlando |
| 6,089,892 | A | 7/2000 | Snow et al. |
| 6,142,833 | A | 11/2000 | Zhu et al. |
| 6,162,077 | A | 12/2000 | Laes et al. |
| 6,168,474 | B1 | 1/2001 | German et al. |

(Continued)

FOREIGN PATENT DOCUMENTS

EP 075510081 B1 5/2002

OTHER PUBLICATIONS

Terminal Disclaimer to Obviate a Provisional Double Patenting Rejection over a Pending Second Application dated Jul. 28, 2009, filed in parent application (U.S. Appl. No. 11/800,587) with respect to second application (U.S. Appl. No. 11/856,920).

(Continued)

*Primary Examiner* — Neil Abrams
*Assistant Examiner* — Travis Chambers
(74) *Attorney, Agent, or Firm* — McCarter & English, LLP

(57) ABSTRACT

Improved connectors and plug/cable assemblies are provided for use in distributing data. The present disclosure provides for electrical connector assemblies for use with electrical wires/cables (e.g., preterminated wires/cables) that include at least one plug member. More particularly, the present disclosure provides for connector assemblies (e.g., port replication connector assemblies) and associated plugs and cables that are adapted for use in multi-connector panels and with patch panels, e.g., for distributing data to computers and computer networks.

20 Claims, 10 Drawing Sheets

(56) References Cited

U.S. PATENT DOCUMENTS

| | | | | |
|---|---|---|---|---|
| 6,193,533 | B1 | 2/2001 | De Win et al. | |
| 6,210,213 | B1 | 4/2001 | Stekelenburg | |
| 6,315,620 | B1 | 11/2001 | Moir et al. | |
| 6,383,028 | B1 | 5/2002 | Chang | |
| 6,454,607 | B2 | 9/2002 | Bricaud | |
| 6,504,726 | B1 | 1/2003 | Grabinger et al. | |
| 6,739,892 | B1 | 5/2004 | Belopolsky et al. | |
| 6,761,585 | B2 | 7/2004 | Clark et al. | |
| 6,984,130 | B2 | 1/2006 | Richter et al. | |
| 6,988,914 | B2 | 1/2006 | Pepe et al. | |
| 6,994,566 | B2 | 2/2006 | You | |
| 7,014,495 | B2 | 3/2006 | Carroll | |
| 7,017,267 | B2 | 3/2006 | Carroll | |
| 7,153,168 | B2 | 12/2006 | Caveney et al. | |
| 7,163,416 | B2 | 1/2007 | Carroll | |
| 7,195,518 | B2 * | 3/2007 | Bert et al. | 439/607.43 |
| 7,229,309 | B2 | 6/2007 | Carroll et al. | |
| 7,335,066 | B2 * | 2/2008 | Carroll et al. | 439/676 |
| 7,628,657 | B2 | 12/2009 | Martich | |
| 7,686,650 | B2 * | 3/2010 | Belopolsky et al. | 439/620.17 |
| 7,695,328 | B2 | 4/2010 | Martich | |
| 8,089,976 | B2 * | 1/2012 | Caveney et al. | 370/401 |
| 8,182,294 | B2 | 5/2012 | Martich et al. | |
| 2002/0168887 | A1 | 11/2002 | Roscizewski et al. | |
| 2006/0009061 | A1 | 1/2006 | Machado et al. | |
| 2006/0181459 | A1 | 8/2006 | Aekins et al. | |
| 2008/0007372 | A1 | 1/2008 | Carroll | |
| 2008/0280500 | A1 | 11/2008 | Matrich | |
| 2010/0173528 | A1 | 7/2010 | Martich et al. | |
| 2011/0275242 | A1 * | 11/2011 | Spitaels et al. | 439/532 |

OTHER PUBLICATIONS

PCT International Search Report and Written Opinion dated Apr. 12, 2011.

PCT International Search Report dated Oct. 30, 2008.

IEC 60603-7-7, Connectors for electronic equipment—Part 7-7: Detail specification for 8-way, shielded free and fixed connectors, for data transmissions with frequencies up to 600 MHz, second edition, Jun. 2006.

* cited by examiner

PORT REPLICATION ASSEMBLY WITH ADAPTER CABLE AND RELATED METHODS OF USE

CROSS-REFERENCE TO RELATED APPLICATIONS

The present application is a continuation-in-part application that claims the benefit of a co-pending, commonly assigned non-provisional patent application entitled "Connector Assembly and Related Methods of Use," which was filed on Mar. 3, 2010, and was assigned Ser. No. 12/714,630 and which claimed priority to a further commonly assigned non-provisional patent application entitled "Subassembly Containing Contact Leads," which was filed on Apr. 21, 2009, and assigned Ser. No. 12/427,128, and which issued on Apr. 13, 2010, as U.S. Pat. No. 7,695,328 and which claimed priority to a further commonly assigned non-provisional patent application entitled "Connector Assembly for Use With Plugs and Preterminated Cables," which was filed on May 7, 2007, assigned Ser. No. 11/800,587, and which issued on Oct. 13, 2009, as U.S. Pat. No. 7,628,657. The contents of the foregoing applications are incorporated in their entirety herein by reference.

BACKGROUND

1. Technical Field

The present disclosure is directed to electrical connector assemblies for use with electrical wires/cables that include at least one plug member, particularly preterminated wires/cables. The present disclosure is further directed to connector assemblies (e.g., port replication connector assemblies) and associated plugs and cables that are adapted for use in multi-connector panels and with patch panels, e.g., for distributing data to computers and computer networks.

2. Background Art

With the continued evolution of data communications equipment, performance standards and requirements continue to advance. The structured cabling industry has experienced a progression from Category 3 level performance standards/requirements, through Category 5/5E, Category 6, and, more recently, Category 6A performance standards/requirements. At each stage, manufacturers of cabling and connector technologies have been required to address data communication capabilities and limitations of their existing product offerings. Of importance in meeting industry requirements is the control/minimization of noise/cross-talk encountered in cabling and connector assemblies. In general, noise/cross-talk issues become more pronounced as data communication frequencies are increased.

Typical connector assemblies include a jack and a plug that are adapted to detachably engage to effect a data communication connection. Common RJ 45 connector assemblies include a jack and a plug, each of which includes eight conductors in a predefined side-by-side orientation. Various techniques have been developed to control/address noise and crosstalk that are generated in the jack/plug interface, including capacitive compensation in the jack and/or plug. Noise/crosstalk compensation may be introduced through physical arrangements of the conductors within the jack and/or plug, as well as compensation introduced on printed circuit boards associated with the jack and/or plug.

Alternative conductor layouts for purposes of jack/plug combinations have been proposed. For example, U.S. Pat. No. 6,162,077 to Laes et al. and U.S. Pat. No. 6,193,533 to De Win et al. disclose male/female connector designs wherein shielded wire pairs are arranged with a plurality of side-by-side contacts and additional contact pairs positioned at respective corners of the male/female connector housings. The foregoing arrangement of contacts/contact pairs for shielded cables is embodied in an International Standard—IEC 60603-7-7—the contents of which are incorporated in their entirety herein by reference. The noted IEC standard applies to high speed communication applications with 8 position, pairs in metal foil (PIMF) shielded, free and fixed connectors, for data transmissions with frequencies up to 600 MHz.

In completing cabling installations, it is generally necessary to feed wiring/cabling from location-to-location, e.g., through conduits and/or in open spaces behind walls, above ceilings and below floors. Frequently, the wire/cable is fed from spools, introduced through the back/side of a wiring box, and terminated by an installation professional, e.g., by punching down individual wires with respect to insulation displacement connectors (IDCs) or the like. According to this conventional installation technique, the installer is able to define the length of each wiring/cabling run at the time of installation, thereby maintaining flexibility. However, the termination process is time-consuming and it is necessary to test/confirm system performance after the installation is complete.

As an alternative installation technique, preterminated wires/cables may be employed to achieve point-to-point wiring connectivity. A preterminated wire/cable generally includes a plug that is pre-mounted with respect to at least one end of a predetermined length of wire/cable. The plug is generally mounted with respect to the wire/cable by the manufacturer and, as part of the manufacturer's quality control procedures, performance at the interface between the wire/cable and the pre-mounted plug is verified before shipment to the installation site.

One type of cabling task is the connection of server(s)/switch(es) to a computer or network of computers. This is sometimes accomplished through the use of rack-mounted patch panels. Patch panels allow establishing and re-routing connections, i.e., by re-arranging the connections, e.g., by removing plugs from jacks and inserting them in alternative jacks. While this type of connectivity provides flexible connections, the plug/jack connections are subject to wear and distortion leading to defective connections and requiring replacement of the jack, cable and/or plug. In instances where the jack is attached to an expensive piece of electronic equipment, such as a server or switch, replacement of a jack can be both inconvenient and expensive and/or places expensive equipment at risk due to the necessity to move and disassemble the equipment.

Despite efforts to date, a need remains for connector assemblies and associated plugs/cables and related methods of use that provide enhanced flexibility and/or performance. These and other needs are satisfied by the connector assemblies, plugs/cables, techniques and methods disclosed herein.

SUMMARY

The present disclosure provides for improved electrical connector assemblies for use with electrical wires/cables (e.g., preterminated wires/cables) that include at least one plug member. More particularly, the present disclosure provides for advantageous connector assemblies (e.g., port replication connector assemblies) and associated plugs/cables that are adapted for use in multi-connector panels and with patch panels, e.g., for distributing data to computers and computer networks. Improved port replication connectors and plug/cable assemblies are provided for use in distributing data.

The present disclosure provides for a preterminated cable assembly including a cable; a first plug mounted with respect to a first end of the cable, the first plug supporting a first plurality of electrical contacts, the first plurality of electrical contacts positioned in quadrants of the first plug so that the first plurality of electrical contacts are arranged in an IEC 60603-7-7 standard contact layout geometric configuration; and a second plug mounted with respect to a second end of the cable, the second plug supporting a second plurality of electrical contacts, the second plurality of electrical contacts arranged in an RJ-45 contact layout geometric configuration.

The present disclosure also provides for a preterminated cable assembly wherein the cable includes a plurality of shielded or unshielded twisted pair wires. The present disclosure also provides for a preterminated cable assembly wherein the first plug is configured and dimensioned to be inserted into a first jack opening to make electrical connection therewith; and wherein the second plug is configured and dimensioned to be inserted into a second jack opening to make electrical connection therewith.

The present disclosure also provides for a preterminated cable assembly wherein the second jack opening is associated with a server or switch. The present disclosure also provides for a preterminated cable assembly wherein the first jack opening is associated with a housing, the housing defining the first jack opening and a third jack opening; wherein a third plurality of electrical contacts are positioned in the first jack opening, the electrical contacts of the third plurality being arranged in an IEC 60603-7-7 standard contact layout geometric configuration; wherein a fourth plurality of electrical contacts are positioned in the third jack opening, the electrical contacts of the fourth plurality being arranged according to a contact layout geometric configuration that is different from the third plurality of electrical contacts; and wherein each electrical contact of the third plurality is electrically continuous with at least one electrical contact of the fourth plurality, and each electrical contact of the fourth plurality is electrically continuous with at least one electrical contact of the third plurality.

The present disclosure also provides for a preterminated cable assembly wherein at least two first pairs of electrical contacts of the third plurality of electrical contacts are upwardly deflectable, and are oriented side-by-side with respect to each other in a corresponding upper portion of the first jack opening; and wherein at least two second pairs of electrical contacts of the third plurality of electrical contacts are downwardly deflectable, and are oriented side-by-side with respect to each other in a corresponding lower portion of the first jack opening.

The present disclosure also provides for a preterminated cable assembly wherein the fourth plurality of electrical contacts are arranged in an RJ-45 contact layout geometric configuration. The present disclosure also provides for a preterminated cable assembly wherein the first jack opening is associated with a housing, the housing defining the first jack opening and a third jack opening; wherein a third plurality of electrical contacts are positioned in the first jack opening, the electrical contacts of the third plurality being arranged in an IEC 60603-7-7 standard contact layout geometric configuration; wherein a fourth plurality of electrical contacts are positioned in the third jack opening, the electrical contacts of the fourth plurality being arranged in an IEC 60603-7-7 standard contact layout geometric configuration; and wherein each electrical contact of the third plurality is electrically continuous with at least one electrical contact of the fourth plurality, and each electrical contact of the fourth plurality is electrically continuous with at least one electrical contact of the third plurality.

The present disclosure also provides for a preterminated cable assembly further including a contact subassembly positioned within the housing; wherein the contact subassembly supports a plurality of contact support members; and wherein each contact support member includes a pair of electrical contacts. The present disclosure also provides for a preterminated cable assembly wherein the contact subassembly includes a printed circuit board, the printed circuit board configured and dimensioned to supply compensation with respect to an electrical connection made with respect to the electrical contacts of the third plurality. The present disclosure also provides for a preterminated cable assembly wherein the first and third jack openings are oppositely directed.

The present disclosure also provides for a preterminated cable assembly wherein the housing is mounted with respect to a patch panel assembly. The present disclosure also provides for a preterminated cable assembly wherein at least two first pairs of electrical contacts of the third plurality of electrical contacts are upwardly deflectable, and are oriented side-by-side with respect to each other in a corresponding upper portion of the first jack opening; and wherein at least two second pairs of electrical contacts of the third plurality of electrical contacts are downwardly deflectable, and are oriented side-by-side with respect to each other in a corresponding lower portion of the first jack opening.

The present disclosure also provides for, in combination, a preterminated cable assembly that includes: (i) a cable, (ii) a first plug mounted with respect to a first end of the cable, the first plug supporting a first plurality of electrical contacts, the first plurality of electrical contacts positioned in quadrants of the first plug so that the first plurality of electrical contacts are arranged in an IEC 60603-7-7 standard contact layout geometric configuration, and (iii) a second plug mounted with respect to a second end of the cable, the second plug supporting a second plurality of electrical contacts, the second plurality of electrical contacts arranged in an RJ-45 contact layout geometric configuration; a connector assembly including: (i) a housing defining a first and second jack opening, the first jack opening configured and dimensioned to receive the first plug, (ii) a third plurality of electrical contacts supported by the housing and positioned in the first jack opening, the electrical contacts of the third plurality being arranged in an IEC 60603-7-7 standard contact layout geometric configuration, (iii) a fourth plurality of electrical contacts supported by the housing and positioned in the second jack opening, the electrical contacts of the fourth plurality being arranged according to a contact layout geometric configuration that is different from the third plurality of electrical contacts; wherein each electrical contact of the third plurality is electrically continuous with at least one electrical contact of the fourth plurality, and each electrical contact of the fourth plurality is electrically continuous with at least one electrical contact of the third plurality of electrical contacts; wherein the first plug of the preterminated cable assembly is inserted into the first jack opening of the connector assembly to make electrical connection therewith; and wherein the second plug of the preterminated cable assembly is inserted into a third jack opening associated with an electrical device to make electrical connection therewith.

The present disclosure also provides for a combination wherein the electrical device is a server or switch. The present disclosure also provides for a combination wherein at least two first pairs of electrical contacts of the third plurality of electrical contacts are upwardly deflectable, and are oriented side-by-side with respect to each other in a corresponding upper portion of the first jack opening; and wherein at least two second pairs of electrical contacts of the third plurality of electrical contacts are downwardly deflectable, and are oriented side-by-side with respect to each other in a corresponding lower portion of the first jack opening.

The present disclosure also provides for, in combination, a preterminated cable assembly that includes: (i) a cable, (ii) a first plug mounted with respect to a first end of the cable, the first plug supporting a first plurality of electrical contacts, the first plurality of electrical contacts positioned in quadrants of the first plug so that the first plurality of electrical contacts are arranged in an IEC 60603-7-7 standard contact layout geometric configuration, and (iii) a second plug mounted with respect to a second end of the cable, the second plug supporting a second plurality of electrical contacts, the second plurality of electrical contacts arranged in an RJ-45 contact layout geometric configuration; a connector assembly including: (i) a housing defining a first and second jack opening, the first jack opening configured and dimensioned to receive the first plug, (ii) a third plurality of electrical contacts supported by the housing and positioned in the first jack opening, the electrical contacts of the third plurality being arranged in an IEC 60603-7-7 standard contact layout geometric configuration, (iii) a fourth plurality of electrical contacts supported by the housing and positioned in the second jack opening, the electrical contacts of the fourth plurality being arranged in an IEC 60603-7-7 standard contact layout geometric configuration; wherein each electrical contact of the third plurality is electrically continuous with at least one electrical contact of the fourth plurality, and each electrical contact of the fourth plurality is electrically continuous with at least one electrical contact of the third plurality of electrical contacts; wherein the first plug of the preterminated cable assembly is inserted into the first jack opening of the connector assembly to make electrical connection therewith; and wherein the second plug of the preterminated cable assembly is inserted into a third jack opening associated with an electrical device to make electrical connection therewith.

The present disclosure also provides for a combination wherein the electrical device is a server or switch. The present disclosure also provides for a combination wherein at least two first pairs of electrical contacts of the third plurality of electrical contacts are upwardly deflectable, and are oriented side-by-side with respect to each other in a corresponding upper portion of the first jack opening; and wherein at least two second pairs of electrical contacts of the third plurality of electrical contacts are downwardly deflectable, and are oriented side-by-side with respect to each other in a corresponding lower portion of the first jack opening.

The present disclosure also provides for a combination wherein at least two first pairs of electrical contacts of the fourth plurality of electrical contacts are upwardly deflectable, and are oriented side-by-side with respect to each other in a corresponding upper portion of the second jack opening; and wherein at least two second pairs of electrical contacts of the fourth plurality of electrical contacts are downwardly deflectable, and are oriented side-by-side with respect to each other in a corresponding lower portion of the second jack opening.

Additional advantageous features, functions and benefits of the disclosed connectors, cable/plug assemblies and techniques will be apparent from the detailed description which follows, particularly when read in conjunction with the appended figures.

BRIEF DESCRIPTION OF FIGURES

To assist those of skill in the art in making and using the disclosed connectors and plug/cable assemblies, reference is made to the accompanying figures, wherein.

DESCRIPTION OF EXEMPLARY EMBODIMENTS

Figure 1:
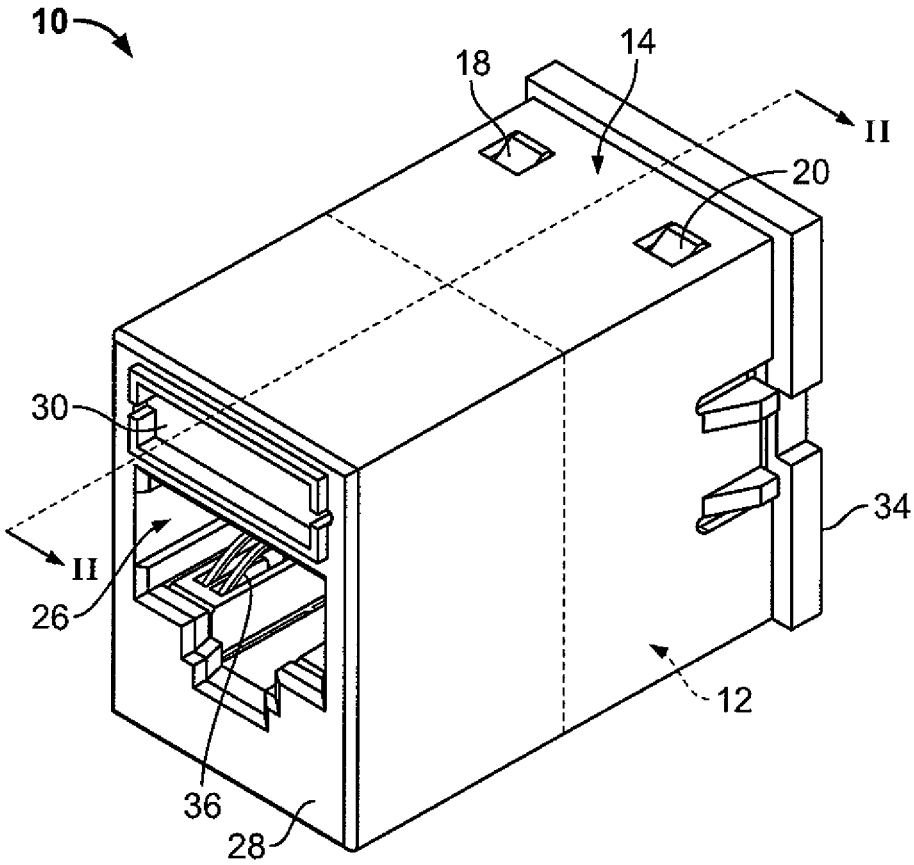
FIG. 1 is a perspective side view of an exemplary connector according to the present disclosure.

In general, improved connectors and cable/plug assemblies are provided for use in distributing data. In exemplary embodiments, the present disclosure provides for advantageous electrical connector assemblies for use with electrical wires/cables (e.g., preterminated wires/cables) that include at least one plug member. More particularly, the present disclosure provides for improved connector assemblies (e.g., port replication connector assemblies) and associated plugs/cables that are adapted for use in multi-connector panels and with patch panels, e.g., for distributing data to computers and computer networks.

Current practice provides that one type of cabling task is the connection of servers or switches to a computer or network of computers, which is sometimes accomplished through the use of rack-mounted patch panels. In general, patch panels allow establishing and re-routing connections by removing plugs from jacks and inserting them in alternative jacks. However, while this type of connectivity provides flexibility, the plug/jack connections are subject to wear and distortion leading to defective connections and requiring replacement of the jack, cable and/or plug. For example, where the jack is attached to an expensive or complex piece of electronic equipment (e.g., server or switch), replacement of a jack can be both inconvenient and expensive. Such replacement may also place expensive equipment at risk due to the necessity to move and disassemble the equipment. In exemplary embodiments, the present disclosure provides for improved port replication connectors and cable/plug assemblies for use between servers/switches and the like and patch panels or connectors or the like to eliminate or reduce the need to remove the jack/plug connection at the server/switch while also providing flexible re-routing connections throughout the data system, thereby providing a significant manufacturing and commercial advantage as a result.

In the description which follows, like parts are marked throughout the specification and drawings with the same reference numerals, respectively. Drawing figures are not necessarily to scale and in certain views, parts may have been exaggerated for purposes of clarity.

Figure 2:
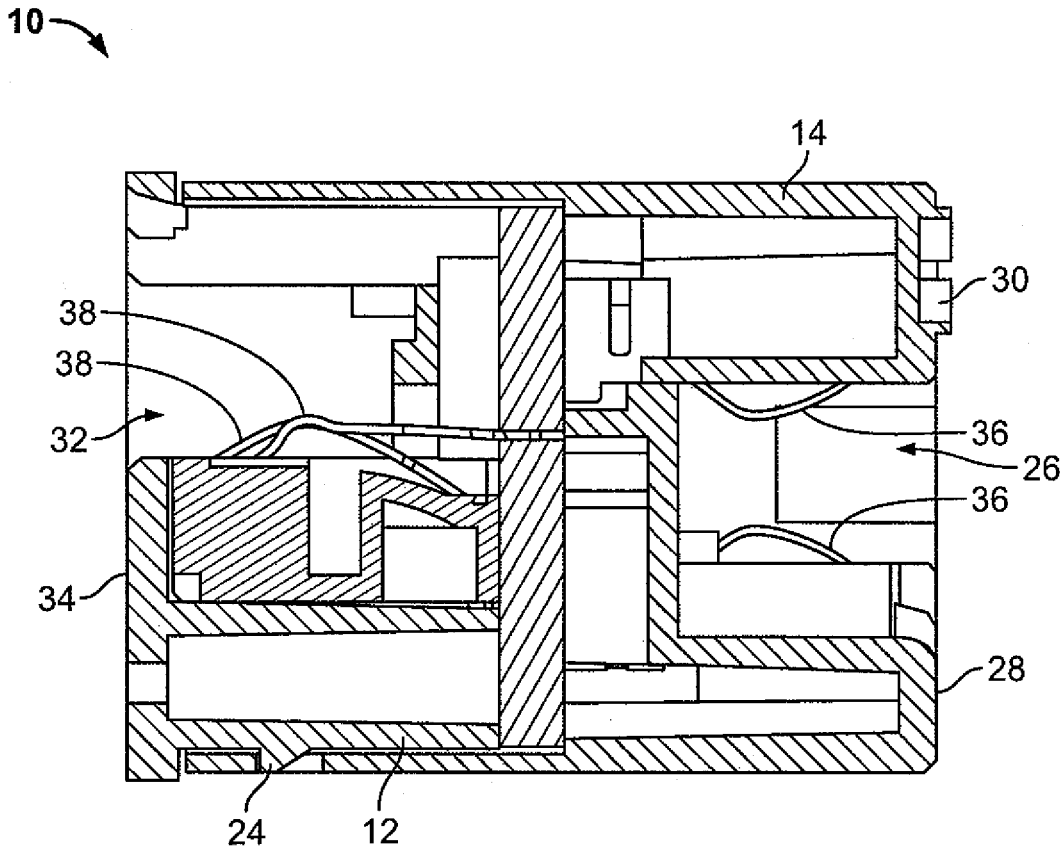
FIG. 2 is a cross-sectional view of the connector of FIG. 1 taken along line II-II and looking in the direction of the arrows.

Referring now to the drawings, FIGS. 1 and 2 show a connector assembly 10 having a first housing 12 and second housing 14 that are adapted to latch together, e.g., by latching members 18, 20 extending from the top surface of first housing 12 and latching member 24 (FIG. 2) extending from a bottom surface of housing 12. Such latching members 18, 20, 24 detachably engage mating slots formed in second housing 14. Second housing 14 has a jack opening 26 on a face 28 thereof. A label slot 30 is provided above jack opening 26 on face 28 to permit an installer to label the electrical connection associated with jack opening 26 for future reference. A jack opening 32 (FIG. 2) is formed on face 34 of first housing 12. A set of contacts 36, 38, respectively, are presented at jack openings 26, 32. In the embodiment shown in FIGS. 1 and 2, the contacts 36, 38 are configured to define two different types of standard jacks, namely, an IEC 60603-7-7 jack at jack opening 26 and an RJ 45 jack at jack opening 32. First housing 12 and second housing 14 are typically fabricated from a plastic material, e.g., polycarbonate.

Figure 3:
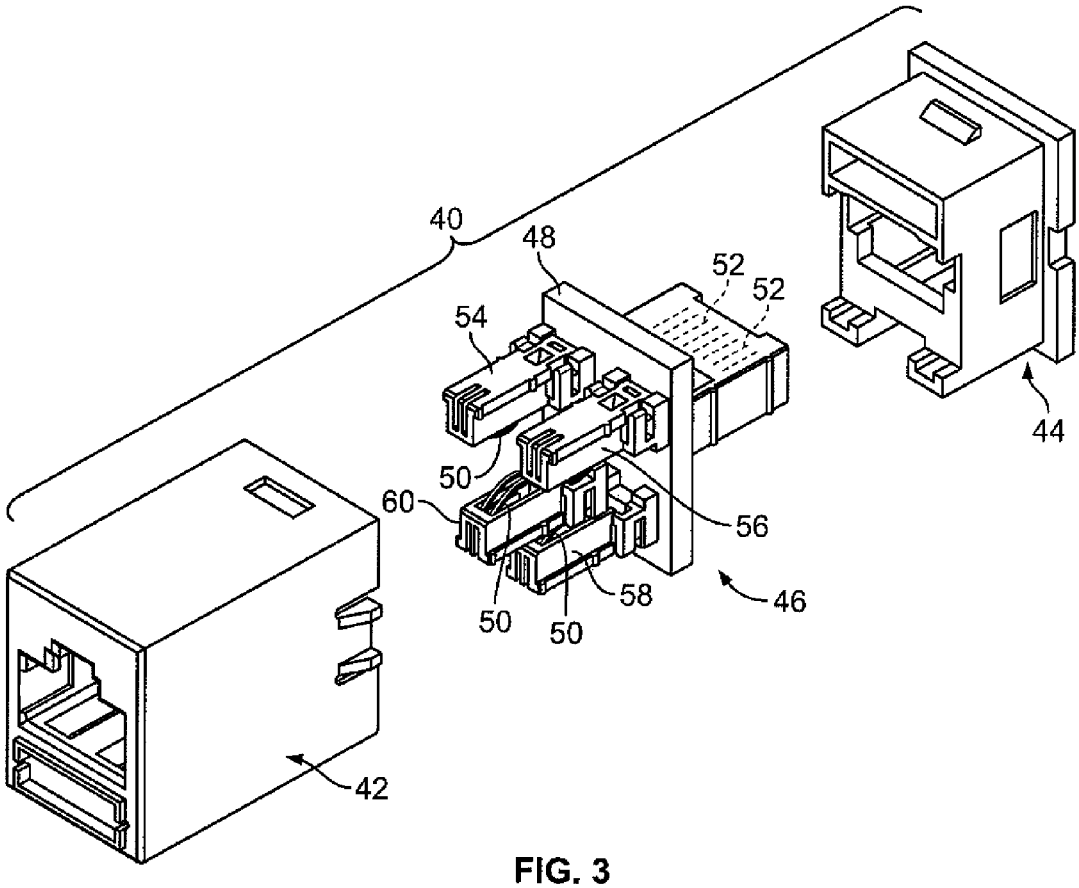
FIG. 3 is an exploded view of an alternative exemplary connector according to the present disclosure.

FIG. 3 illustrates a connector assembly 40 having a pair of housings 42, 44 like those of the embodiment shown in FIGS. 1 and 2. The housings 42, 44 capture a contact subassembly 46 therein when snapped/attached together. Contact subassembly 46 has printed circuit board 48 which electrically connects a first set of electrical contacts 50 to a second set 52 (shown in dotted lines). In the embodiment shown in FIG. 3, the first set of electrical contacts 50 have a configuration suitable for an IEC 60603-7-7 jack and the second set of electrical contacts 52 are in the form of an RJ 45 jack. As described more fully in the applications incorporated herein by reference above (e.g., the parent patent applications), a plurality of contact support members 54, 56, 58, 60 provide mechanical support for the first set of contacts 50 and the printed circuit board 48 provides electrical connectivity between the contact sets 50 and 52, e.g., through circuit traces and/or cross-talk compensation circuitry.

Figure 4:
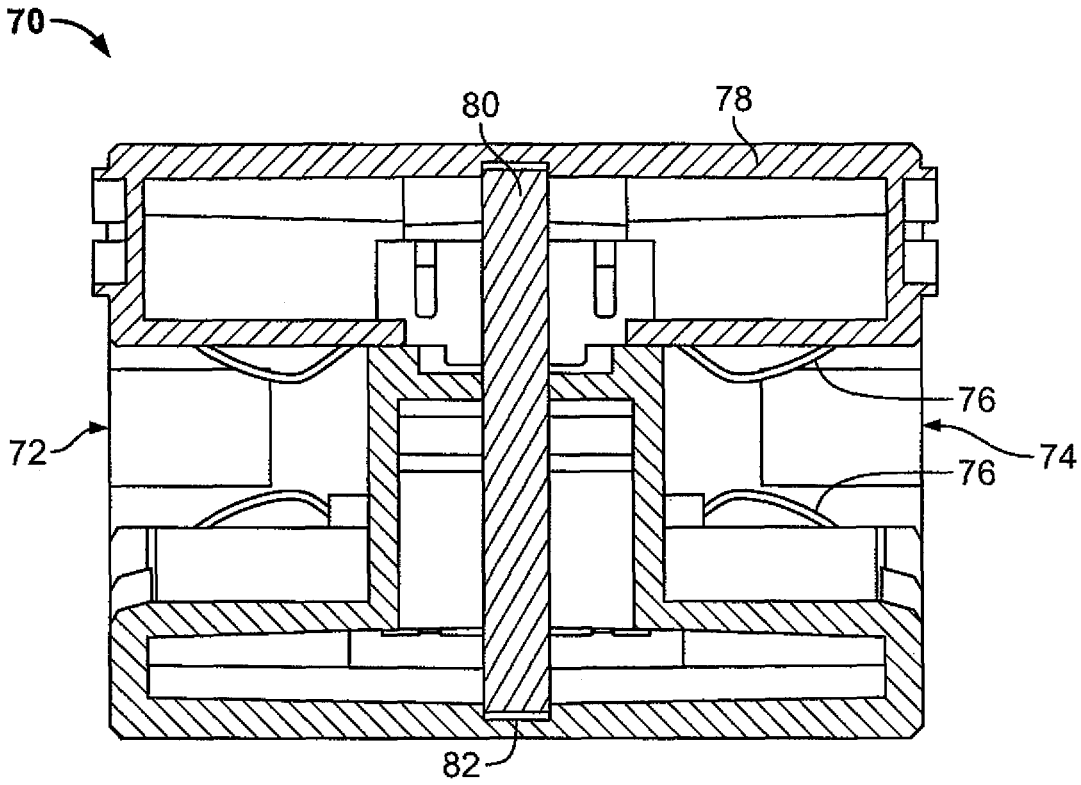
FIG. 4 is a cross-sectional view like that of FIG. 2, of a connector in accordance with another embodiment of the present disclosure.
Figure 5:
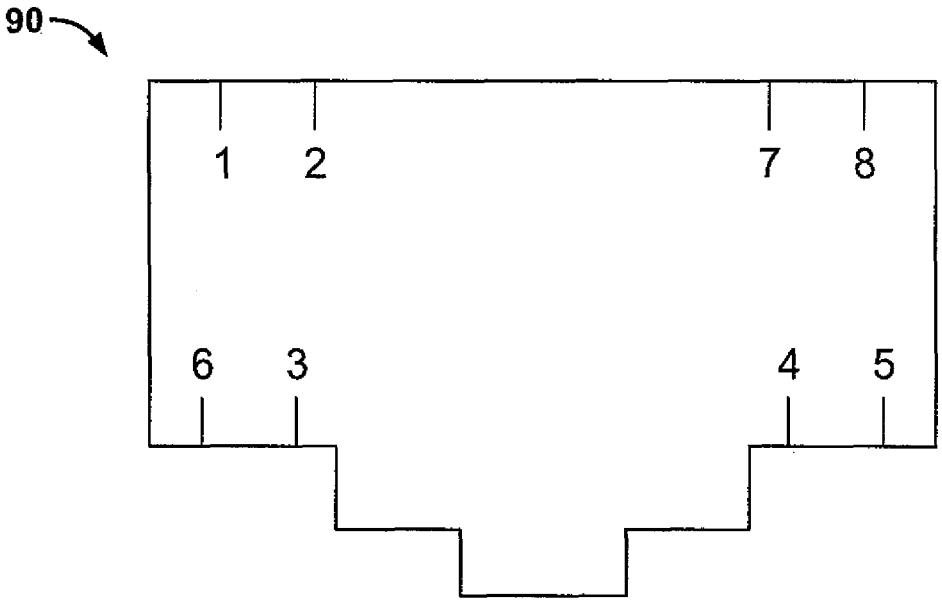
FIGS. 5 and 6 are schematic views of two different connectors having different contact configurations.
Figure 6:
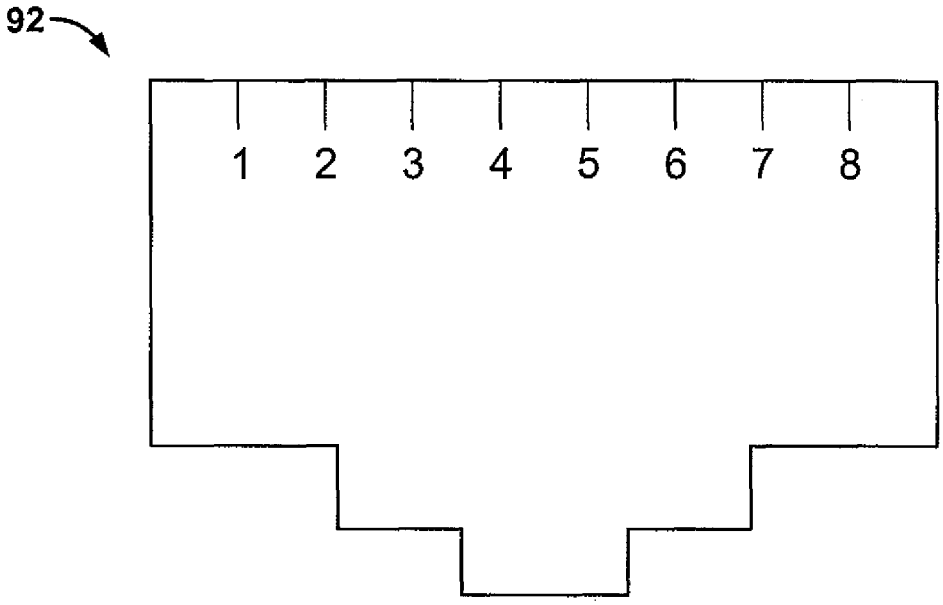

FIG. 4 shows an alternative connector 70 similar to those described above relative to FIGS. 1-3, but having first and second jacks 72, 74 of the same type, illustrating that the present disclosure is intended to encompass a connector 70 having two jacks of the same type. While jacks 72, 74 have features indicative of an IEC 60603-7-7 jack, i.e., the contacts 76 are longitudinally opposed, the jacks 72, 74 could be in any form, e.g., both could be RJ 45 jacks or they could be two different types of jacks. FIG. 5 diagrammatically shows the contact configuration 90 for an IEC 60603-7-7 jack and FIG. 6 diagrammatically shows the contact configuration 92 for an RJ 45 jack. Referring again to FIG. 4, variations in the housing 78 may be made, e.g., by providing a housing bifurcated at the plane of the cross-section, as illustrated in FIG. 4, and capturing a printed circuit board 80 (that intermediates between the jacks 72, 74) in an internal groove 82, when conjoined to form the housing 78.

Figure 7:
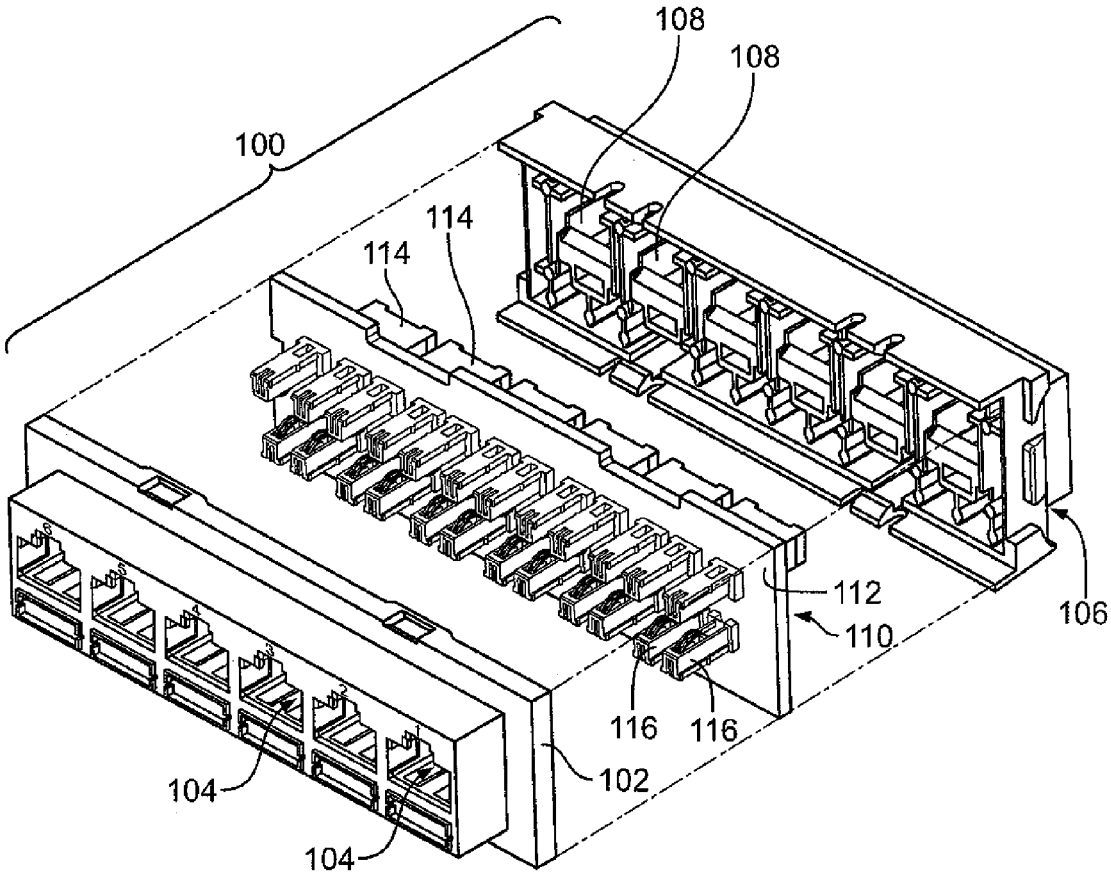
FIG. 7 is an exploded panel assembly with multiple connectors according to the present disclosure.

FIG. 7 shows a multi-connector panel assembly 100 having a first housing 102 with a plurality of jack openings 104, each for receipt of a mating plug (not shown). A second housing 106 has a corresponding plurality of jack openings 108. A contact subassembly 110 includes a PCB board 112 upon which is mounted a plurality of contact inserts 114 and a plurality of contact supports 116, which are grouped in sets like those shown in FIG. 3 to configure a plurality of contacts in a standard configuration, such as those of IEC 60603-7-7 jacks. The contact inserts 114 house a plurality of contacts like contacts 52 of FIG. 3 and insert into jack openings 108. The contact supports 116 provide mechanical support for a plurality of contacts (e.g., similar to contacts 50 of FIG. 3), and the contact supports 116 are slideably received in first housing 102 providing jack openings 104 with the contacts required of a standard jack, e.g., an IEC 60603-7-7 jack. FIG. 7 therefore illustrates that the connector technology described above in reference to FIGS. 1-6 can be replicated in multiple, side-by-side units to yield a multi-connector panel 100. As noted above with respect to the individual connectors of FIGS. 1-6, the connector configuration available at jack openings 104 and 108 can be the same or may be different, e.g., one or both may be RJ 45 or IEC 60603-7-7 jacks, and the jacks at jack openings 104 are in electrical communication with corresponding jacks present at jack openings 108 (e.g., via PCB board 112).

Figure 8:
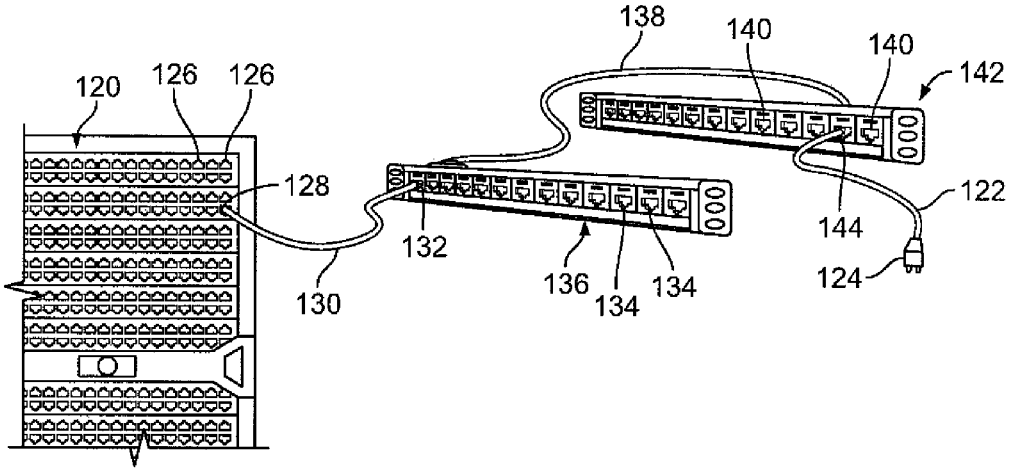
FIG. 8 (Prior Art)
FIG. 8 is a schematic view of a system for connecting a data source to a computer or computer network utilizing patch panels as would be known in the prior art.
Figure 10:
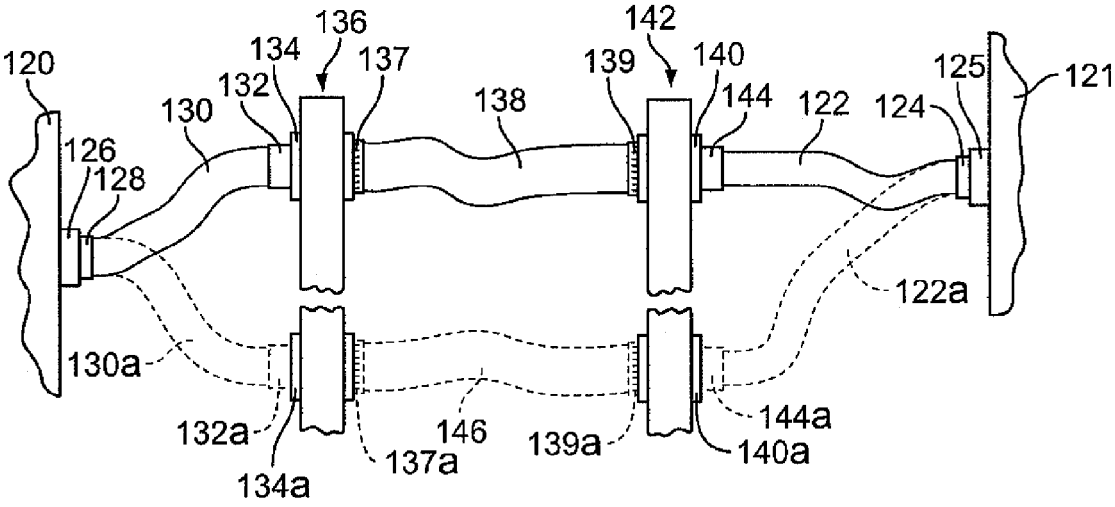
FIG. 10 (Prior Art)
FIG. 10 is a schematic view of the system of FIG. 8 in two different states of connectivity.

FIGS. 8 and 10 show diagrams of the connection of a server or switch 120 to a computer 121 or a computer network (not shown) via intermediating elements ending in a cable 122 and plug 124 that may be connected to jack 125 on the computer 121 or computer network. The server 120 has a plurality of outlet jacks 126, e.g., RJ 45 jacks that may receive a mating plug, such as plug 128 on cable 130. Cable 130 has another plug 132 at the other end, which is plugged into a mating jack 134 of a first patch panel 136. The jack 134 is connected at the rear of patch panel 136 to an intermediate cable 138, typically by a punch-down IDC (insulation displacement connector) 137 (See FIG. 10). The intermediate cable 138 runs to and connects to the rear of a jack 140 of a second patch panel 142, again typically by a punch-down IDC connector 139. The jack 140 to which cable 138 connects may receive a plug 144 of cable 122, the other end of which 124 plugs into jack 125 of computer 121. Typically all plugs 124, 128, 132 and 144 in this arrangement are RJ 45 plugs. As shown in FIG. 10, in the event that it is desirable to re-rout cable 122 to another jack **140*a*, i.e., to occupy the position shown in dotted lines and labeled 122*a*, it would be necessary to either break the connection 139 and move cable 138 to connection 139*a*, or to put a new cable 146 to connection 137*a* associated with jack 134*a*. This would further require unplugging plug 132 from jack 134 and moving it to position 132*a* in socket 134*a*. It is possible to do this without harm, but each instance of unplugging/plugging a plug into a jack risks bending, breaking or otherwise disturbing the contacts of the plug/jack. While the breakage of a jack 134 or a plug 132 is relatively inconsequential in itself, if the plug 132 is broken, then the cable 130 would need to be replaced, necessitating removal of plug 128 from jack 126 which is located on the server/switch 120. As noted before, each instance of unplugging/plugging into the jack 126 increases the risk that the jack 126 will be compromised. In the event that jack 126 is compromised, it would be necessary to remove and replace the jack 126 in the server/switch 120, thereby necessitating the removal, disassembly, re-assembly and/or replacement of the server/switch 120, thereby placing the expensive server/switch 120** at risk of damage.

Figure 9:
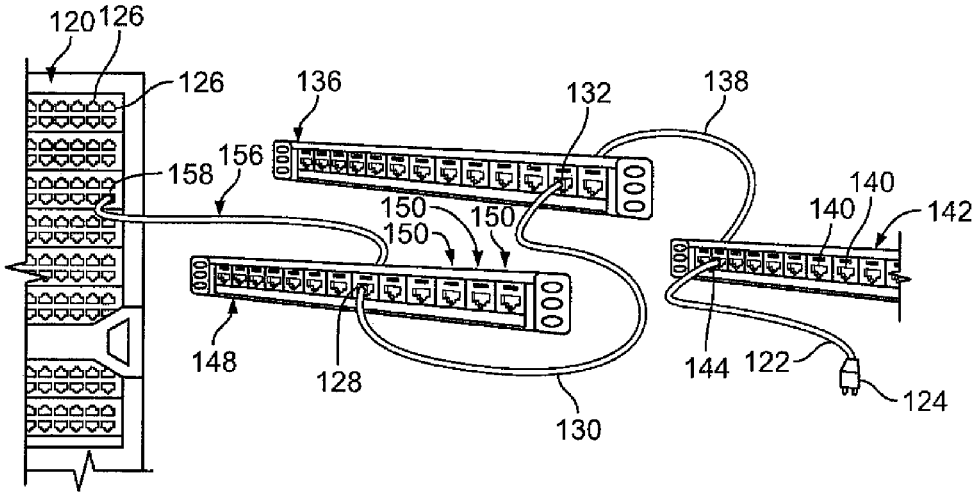
FIG. 9 is a schematic view of a system for connecting a data source to a computer or computer network utilizing patch panels and a port replication assembly in accordance with the present disclosure.
Figure 11:
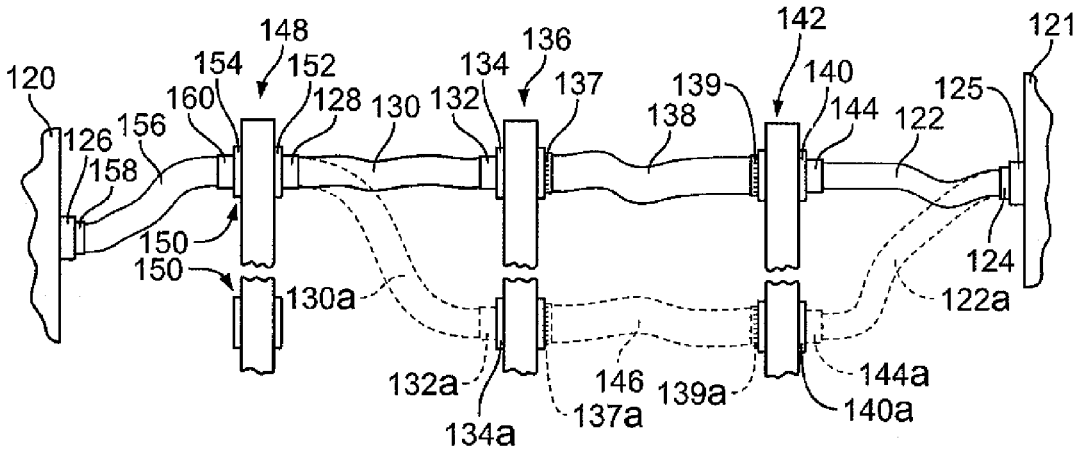
FIG. 11 is a schematic view of the system of FIG. 9 in two different states of connectivity.

FIGS. 9 and 11 show an embodiment in accordance with the present disclosure wherein an advantageous port replication panel assembly 148, like multi-connector panel assembly 100 shown in FIG. 7 (or like connector assemblies shown in FIGS. 1-4), is used to intermediate between the server/switch 120 and the patch panel 136. In one embodiment, port replication panel assembly 148 has more connectors or grouped contacts 150, each with front and rear jacks 152, 154, respectively, than are shown in the multi-connector panel assembly 100 of FIG. 7, but is otherwise constructed with similar features and functionality. A cable assembly 155 (FIG. 12) with a connector cable 156 has a plug 158 at one end with the appropriate configuration for reception by the jack 126 (e.g., RJ 45 jack) of the server/switch 120, which is unchanged from the example shown in FIGS. 8 and 10, and a plug 160 at the other end for reception in jack 154 (e.g., IEC 60603-7-7 jack) of the port replication panel assembly 148. (FIGS. 9 and 11). Typically, jack 126 of server/switch 120 is an RJ 45 jack, although the present disclosure is not limited thereto.

Figure 12:
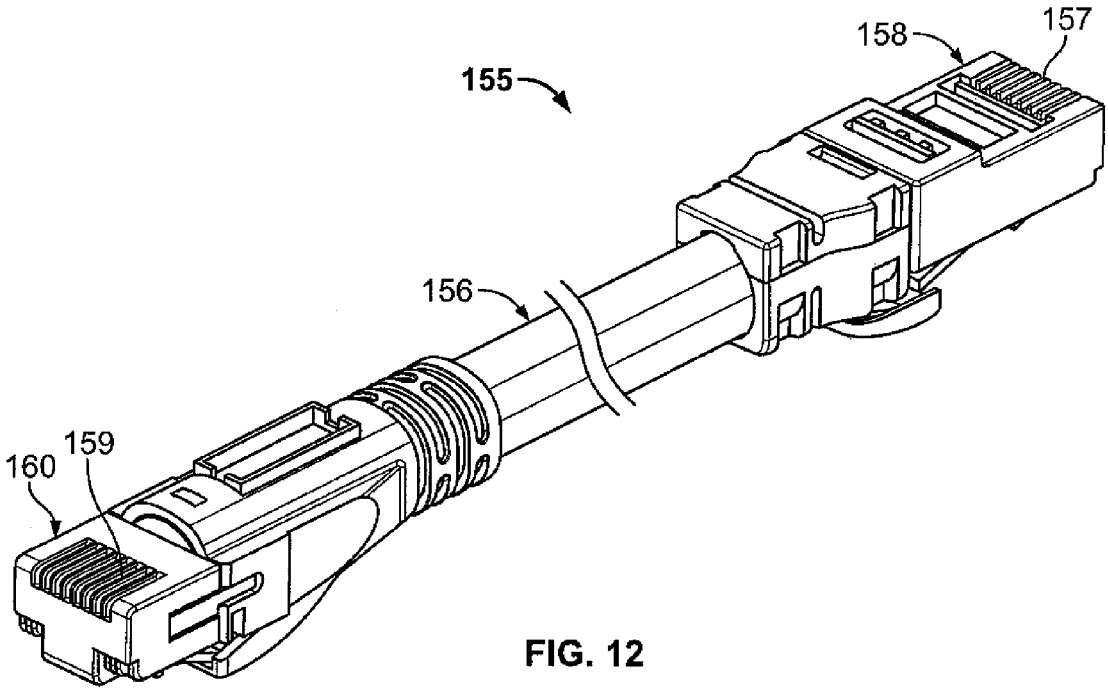
FIG. 12 is a perspective view of an exemplary cable assembly in accordance with the present disclosure.

FIG. 12 shows exemplary cable assembly 155 including cable 156 having a male plug 158, 160, respectively, at each end. As shown in FIG. 11, cable assembly 155 is advantageously configured and dimensioned to connect server/switch 120 to the port replication panel assembly 148. In the embodiment shown, plug 158 typically has an RJ 45 configuration, and plug 160 typically has an IEC 60603-7-7 configuration. Thus, rear jack 154 utilized in exemplary port replication panel assembly 148 is an IEC 60603-7-7 jack that is configured and dimensioned to matingly receive plug 160 of cable assembly 155. Front jack 152 of port replication panel assembly 148 could be either an IEC 60603-7-7 jack or another type of jack, e.g., an RJ 45 jack. Cable 156 typically features shielded twisted pair (STP), fully shielded twisted pair (FTP) or unshielded twisted pair (UTP) wires.

As shown in FIG. 11, in the event that it is desirable to re-rout cable 122 to another jack 140*a*, i.e., to occupy the position shown in dotted lines and labeled 122*a*, it would be necessary to either break the connection 139 and move cable 138 to connection 139*a*, or to put a new cable 146 to connection 137*a* associated with jack 134*a*. This would further require unplugging plug 132 from jack 134 and moving it to position 132*a* in jack 134*a*. As noted above, each instance of unplugging/plugging a plug into a jack risks bending, breaking or otherwise disturbing the contacts of the plug/jack. However and in distinct contrast to the prior art system described above in FIGS. 8 and 10, if plug 132 in the disclosed advantageous system of FIG. 11 is broken and cable 130 needs to be replaced, this would only necessitate the removal of plug 128 from front jack 152 of port replication panel assembly 148, and not from jack 126 of the expensive server/switch 120 as is the case with the prior art system illustrated in FIGS. 8 and 10. The improved system disclosed in FIGS. 9 and 11 thereby reduces the risk that jack 126 of expensive server/switch 120 is damaged/compromised, thereby providing a significant manufacturing and commercial advantage as a result. In the event that port replication panel assembly 148 becomes damaged over time, the general replacement cost and network downtime would be significantly less than the expense of replacing/repairing server/switch 120.

Stated another way, when the jack fields 126 of server/switch 120 are used regularly for cross connect administration, the ports and/or jacks 126 of server/switch 120 may become damaged. To mitigate this risk to costly active equipment (e.g., server/switch 120), port replication panel assembly 148 may be advantageously introduced between patch panel 136 and server/switch 120, via cable 156 and plugs 158, 160. This thereby creates a replicated port, providing an efficient and low cost administration point, while leaving the server/switch 120 port(s) essentially untouched.

As noted above and as shown in FIG. 12, plug 158 typically has an RJ 45 contact layout configuration, and plug 160 typically has an IEC 60603-7-7 contact layout configuration. In exemplary embodiments, cable assembly 155 utilizes a modular plug termination (RJ 45) at plug 158 and a cable termination (IEC 60603-7-7 standard) at plug 160.

Cable assembly 155 is typically a preterminated assembly, whereby plugs 158, 160 are pre-mounted to cable 156 before shipment to an installation location or distribution channel. In general, individual wires of plugs 158, 160 are brought into electrical communication with electrical contacts 157, 159 that are exposed relative to the exterior of plugs 158, 160. In exemplary embodiments, contacts 159 of plug 160 are positioned in quadrants of plug 160 such that plug 160 complies with the contact geometry set forth in the IEC 60603-7-7 standard. Plug 160 with IEC 60603-7-7 contact geometry is advantageously adapted to engage and electrically communicate with a jack assembly (e.g., jack 154 of port replication panel assembly 148). In general, contacts 157 of plug 158 are positioned in a conventional 8-position RJ 45 contact layout, although the present disclosure is not limited thereto.

Such configuration of cable assembly 155 results in exemplary plug 160 being reduced in size, thereby enabling easier routing of cable assembly 155 through the system (e.g., through the racks, cabinets, cable management systems and/or pathways) while providing a high speed connection. In addition, individual plugs 160 of bundled cable assemblies 155 can be passed through one at a time through the system or data center. When in position, exemplary plugs 160 are configured and dimensioned to snap fit, attach and/or terminate into the rear of assembly 148, completing the termination. In exemplary embodiments, cable assembly 155 allows for improved pair-to-pair isolation and improved pair balance through cable assembly 155, which results in greater channel immunity from internal and or external noise, which ensures consistently high performance links and channels. More particularly, cable assembly 155 improves crosstalk and balance performance by isolating pairs and maintaining pair geometry through the termination.

Moreover, it has been found that each use of an IEC 60603-7-7 jack/plug combination (e.g., in the system illustrated in FIG. 11) reduces cross-talk over other types of jack/plug combinations, such as an RJ 45 jack/plug combination. Thus, it may be beneficial to utilize port replication panels 148 to replace the patch panels, e.g., patch panels 136 and 142 shown in FIG. 11, in each instance using an IEC 60603-7-7 jack/plug combination at each interface where it can be used (e.g., at 132/134, 137, 139 and/or 140/144). With such configuration, cable 122 could be replaced with a cable similar to cable 156, i.e., with the computer/computer network 121 typically utilizing an RJ 45 jack for receiving an RJ 45 plug.

Although the systems and methods of the present disclosure have been described with reference to exemplary embodiments thereof, the present disclosure is not limited to such exemplary embodiments and/or implementations. Rather, the systems and methods of the present disclosure are susceptible to many implementations and applications, as will be readily apparent to persons skilled in the art from the disclosure hereof. The present disclosure expressly encompasses such modifications, enhancements and/or variations of the disclosed embodiments. Since many changes could be made in the above construction and many widely different embodiments of this disclosure could be made without departing from the scope thereof, it is intended that all matter contained in the drawings and specification shall be interpreted as illustrative and not in a limiting sense. Additional modifications, changes, and substitutions are intended in the foregoing disclosure. Accordingly, it is appropriate that the appended claims be construed broadly and in a manner consistent with the scope of the disclosure.

What is claimed is:

1. A preterminated cable assembly comprising:

a cable;

a first plug mounted with respect to a first end of the cable, the first plug supporting a first plurality of electrical contacts, the first plurality of electrical contacts including eight contacts defining a first four pairs of contacts, each of the first four pairs of contacts positioned in respective quadrants of the first plug; and a second plug mounted with respect to a second end of the cable, the second plug supporting a second plurality of electrical contacts, the second plurality of electrical contacts arranged in a pre-defined side-by-side RJ-45 contact layout geometric configuration.

2. The assembly of claim 1, wherein the cable includes a plurality of shielded or unshielded twisted pair wires.

3. The assembly of claim 1, wherein the first plug is configured and dimensioned to be inserted into a first jack opening to make electrical connection therewith; and wherein the second plug is configured and dimensioned to be inserted into a second jack opening to make electrical connection therewith.

4. The assembly of claim 3, wherein the second jack opening is associated with a server or switch.

5. The assembly of claim 3, wherein the first jack opening is associated with a housing, the housing defining the first jack opening and a third jack opening;

wherein a third plurality of electrical contacts are positioned in the first jack opening, the electrical contacts of the third plurality including eight contacts defining a first four pairs of contacts, each of the first four pairs of contacts positioned in respective quadrants of the first jack opening;

wherein a fourth plurality of electrical contacts are positioned in the third jack opening, the electrical contacts of the fourth plurality being arranged according to a contact layout geometric configuration that is different from the third plurality of electrical contacts; and wherein each electrical contact of the third plurality is electrically continuous with at least one electrical contact of the fourth plurality, and each electrical contact of the fourth plurality is electrically continuous with at least one electrical contact of the third plurality.

6. The assembly of claim 5, wherein at least two first pairs of electrical contacts of the third plurality of electrical contacts are upwardly deflectable, and are oriented side-by-side with respect to each other in a corresponding upper portion of the first jack opening; and wherein at least two second pairs of electrical contacts of the third plurality of electrical contacts are downwardly deflectable, and are oriented side-by-side with respect to each other in a corresponding lower portion of the first jack opening.

7. The assembly of claim 5, wherein the fourth plurality of electrical contacts are arranged in a pre-defined side-by-side RJ-45 contact layout geometric configuration.

8. The assembly of claim 5, wherein the first and third jack openings are oppositely directed.

9. The assembly of claim 5, wherein the housing is mounted with respect to a patch panel assembly.

10. The assembly of claim 5 further comprising a contact subassembly positioned within the housing;

wherein the contact subassembly supports a plurality of contact support members; and wherein each contact support member includes a pair of electrical contacts.

11. The assembly of claim 10, wherein the contact subassembly includes a printed circuit board, the printed circuit board configured and dimensioned to supply compensation with respect to an electrical connection made with respect to the electrical contacts of the third plurality.

12. The assembly of claim 3, wherein the first jack opening is associated with a housing, the housing defining the first jack opening and a third jack opening;

wherein a third plurality of electrical contacts are positioned in the first jack opening, the electrical contacts of the third plurality including eight contacts defining a first four pairs of contacts, each of the first four pairs of contacts positioned in respective quadrants of the first jack opening;

wherein a fourth plurality of electrical contacts are positioned in the third jack opening, the electrical contacts of the fourth plurality including eight contacts defining a first four pairs of contacts, each of the first four pairs of contacts positioned in respective quadrants of the third jack opening; and wherein each electrical contact of the third plurality is electrically continuous with at least one electrical contact of the fourth plurality, and each electrical contact of the fourth plurality is electrically continuous with at least one electrical contact of the third plurality.

13. The assembly of claim 12, wherein at least two first pairs of electrical contacts of the third plurality of electrical contacts are upwardly deflectable, and are oriented side-by-side with respect to each other in a corresponding upper portion of the first jack opening; and wherein at least two second pairs of electrical contacts of the third plurality of electrical contacts are downwardly deflectable, and are oriented side-by-side with respect to each other in a corresponding lower portion of the first jack opening.

14. In combination:

a preterminated cable assembly that includes: (i) a cable, (ii) a first plug mounted with respect to a first end of the cable, the first plug supporting a first plurality of electrical contacts, the first plurality of electrical contacts including eight contacts defining a first four pairs of contacts, each of the first four pairs of contacts positioned in respective quadrants of the first plug, and (iii) a second plug mounted with respect to a second end of the cable, the second plug supporting a second plurality of electrical contacts, the second plurality of electrical contacts arranged in a pre-defined side-by-side RJ-45 contact layout geometric configuration;

a connector assembly including: (i) a housing defining a first and second jack opening, the first jack opening configured and dimensioned to receive the first plug, (ii) a third plurality of electrical contacts supported by the housing and positioned in the first jack opening, the electrical contacts of the third plurality including eight contacts defining a first four pairs of contacts, each of the first four pairs of contacts positioned in respective quadrants of the first jack opening, (iii) a fourth plurality of electrical contacts supported by the housing and positioned in the second jack opening, the electrical contacts of the fourth plurality being arranged according to a contact layout geometric configuration that is different from the third plurality of electrical contacts;

wherein each electrical contact of the third plurality is electrically continuous with at least one electrical contact of the fourth plurality, and each electrical contact of the fourth plurality is electrically continuous with at least one electrical contact of the third plurality of electrical contacts;

wherein the first plug of the preterminated cable assembly is inserted into the first jack opening of the connector assembly to make electrical connection therewith; and wherein the second plug of the preterminated cable assembly is inserted into a third jack opening associated with an electrical device to make electrical connection therewith.

15. The combination of claim 14, wherein the electrical device is a server or switch.

16. The combination of claim 14, wherein at least two first pairs of electrical contacts of the third plurality of electrical contacts are upwardly deflectable, and are oriented side-by-side with respect to each other in a corresponding upper portion of the first jack opening; and wherein at least two second pairs of electrical contacts of the third plurality of electrical contacts are downwardly deflectable, and are oriented side-by-side with respect to each other in a corresponding lower portion of the first jack opening.

17. In combination:

a preterminated cable assembly that includes: (i) a cable, (ii) a first plug mounted with respect to a first end of the cable, the first plug supporting a first plurality of electrical contacts, the first plurality of electrical contacts including eight contacts defining a first four pairs of contacts, each of the first four pairs of contacts positioned in respective quadrants of the first plug, and (iii) a second plug mounted with respect to a second end of the cable, the second plug supporting a second plurality of electrical contacts, the second plurality of electrical contacts arranged in a pre-defined side-by-side RJ-45 contact layout geometric configuration;

a connector assembly including: (i) a housing defining a first and second jack opening, the first jack opening configured and dimensioned to receive the first plug, (ii) a third plurality of electrical contacts supported by the housing and positioned in the first jack opening, the electrical contacts of the third plurality including eight contacts defining a first four pairs of contacts, each of the first four pairs of contacts positioned in respective quadrants of the first jack opening, (iii) a fourth plurality of electrical contacts supported by the housing and positioned in the second jack opening, the electrical contacts of the fourth plurality including eight contacts defining a first four pairs of contacts, each of the first four pairs of contacts positioned in respective quadrants of the second jack opening;

wherein each electrical contact of the third plurality is electrically continuous with at least one electrical contact of the fourth plurality, and each electrical contact of the fourth plurality is electrically continuous with at least one electrical contact of the third plurality of electrical contacts;

wherein the first plug of the preterminated cable assembly is inserted into the first jack opening of the connector assembly to make electrical connection therewith; and wherein the second plug of the preterminated cable assembly is inserted into a third jack opening associated with an electrical device to make electrical connection therewith.

18. The combination of claim 17, wherein the electrical device is a server or switch.

19. The combination of claim 17, wherein at least two first pairs of electrical contacts of the third plurality of electrical contacts are upwardly deflectable, and are oriented side-by-side with respect to each other in a corresponding upper portion of the first jack opening; and wherein at least two second pairs of electrical contacts of the third plurality of electrical contacts are downwardly deflectable, and are oriented side-by-side with respect to each other in a corresponding lower portion of the first jack opening.

20. The combination of claim 19, wherein at least two first pairs of electrical contacts of the fourth plurality of electrical contacts are upwardly deflectable, and are oriented side-by-side with respect to each other in a corresponding upper portion of the second jack opening; and wherein at least two second pairs of electrical contacts of the fourth plurality of electrical contacts are downwardly deflectable, and are oriented side-by-side with respect to each other in a corresponding lower portion of the second jack opening.

* * * * *